US012635785B2

(12) United States Patent
Cheng et al.

(10) Patent No.: US 12,635,785 B2
(45) Date of Patent: May 26, 2026

(54) METHODS, SYSTEMS, AND APPARATUSES FOR ERGONOMIC LATCHING AND RELEASE OF WEARABLE DEVICES

(71) Applicant: Hand Held Products, Inc., Charlotte, NC (US)

(72) Inventors: Hong Kun Cheng, Charlotte, NC (US); Hardik Yomesh Jani, Charlotte, NC (US); Kevin Saber, Charlotte, NC (US); Quinton Theron, Charlotte, NC (US)

(73) Assignee: Hand Held Products, Inc., Charlotte, NC (US)

( * ) Notice: Subject to any disclaimer, the term of this patent is extended or adjusted under 35 U.S.C. 154(b) by 140 days.

(21) Appl. No.: 18/463,888

(22) Filed: Sep. 8, 2023

(65) Prior Publication Data

US 2024/0099445 A1 Mar. 28, 2024

(30) Foreign Application Priority Data

Sep. 23, 2022 (CN) ..... 202211164478.9

(51) Int. Cl.
*A45F 5/00* (2006.01)

(52) U.S. Cl.
CPC ..... *A45F 5/00* (2013.01); *A45F 2005/008* (2013.01)

(58) Field of Classification Search
CPC .. A45F 5/1516; A45F 2005/008; A45F 5/021; A45F 5/1525; G06F 1/163;
(Continued)

(56) References Cited

U.S. PATENT DOCUMENTS 5,825,874 A * 10/1998 Humphreys ..... H04M 1/04 379/446
5,832,082 A * 11/1998 Nagai ..... B60R 11/0241 379/426

(Continued)

FOREIGN PATENT DOCUMENTS

CN 101346889 A 1/2009
WO 2018/126529 A1 7/2018

OTHER PUBLICATIONS

Extended European Search Report Mailed on Jan. 25, 2024 for EP Application No. 23192329, 11 page(s).

(Continued)

*Primary Examiner* — Adam J Waggenspack
(74) *Attorney, Agent, or Firm* — Alston & Bird LLP

(57) ABSTRACT

Methods, apparatuses, systems, and/or the like are provided. An example method may include operably attaching a wearable device to a mounting apparatus. An example wearable device may include one of a guide surface and an attachment mechanism and one of a receptor and a latching mechanism. The wearable device may be rotatable relative to the mounting apparatus in which the latching mechanism and the receptor are disengaged. The mounting apparatus may include the other of the guide surface and the attachment mechanism and the other of the receptor and the latching mechanism. The latching mechanism may include a release button. The wearable device may be aligned with the mounting apparatus. The attachment mechanism may be engaged with the guide surface, and the latching mechanism may be engaged with the receptor.

17 Claims, 13 Drawing Sheets

(58) Field of Classification Search
CPC .... H04M 1/04; H04B 1/3888; Y10S 224/929; Y10S 224/93
USPC ..... 224/929, 930
See application file for complete search history.

(56) References Cited

U.S. PATENT DOCUMENTS

| | | | | |
|---|---|---|---|---|
| 5,995,622 | A * | 11/1999 | Roussy | B60R 11/0241 379/446 |
| 9,078,498 | B2 * | 7/2015 | Richardson | A45F 5/00 |
| 9,144,168 | B2 | 9/2015 | Sedillo et al. | |
| 9,742,885 | B2 | 8/2017 | Rostami | |
| 10,789,436 | B1 | 9/2020 | Lim et al. | |
| 2011/0270469 | A1 * | 11/2011 | Bopp | G06F 1/163 361/679.01 |
| 2013/0235546 | A1 | 9/2013 | Sedillo et al. | |
| 2013/0270850 | A1 * | 10/2013 | Fan | A45F 5/00 294/137 |
| 2014/0131408 | A1 * | 5/2014 | Brittain | F16M 11/041 224/570 |
| 2020/0187632 | A1 * | 6/2020 | Michael | F41C 33/041 |
| 2021/0027031 | A1 | 1/2021 | Lim et al. | |

OTHER PUBLICATIONS

UROVO, "UROVO U2", retrieved from the Internet at URL: <https://www.urovo.com.au/products/u2-wearable-mobile-computer/> on Feb. 18, 2024, 5 pages.
Youtube, "UROVO U2 review of wrist data collection terminal", retrieved from the Internet at URL: <https://www.youtube.com/watch?v=3XogT16kffE> on Feb. 18, 2024, 2 pages.
EP Office Action Mailed on Jul. 18, 2025 for EP Application No. 23192329, 7 page(s).
Communication about intention to grant a European patent Mailed on Mar. 16, 2026 for EP Application No. 23192329, 6 page(s).

* cited by examiner

METHODS, SYSTEMS, AND APPARATUSES FOR ERGONOMIC LATCHING AND RELEASE OF WEARABLE DEVICES

CROSS-REFERENCE TO RELATED APPLICATIONS

This application claims priority pursuant to 35 U.S.C. 119(a) to Chinese Application No. 202211164478.9, filed Sep. 23, 2022, which application is incorporated herein by reference in its entirety.

TECHNICAL FIELD

The present disclosure relates generally to wearable devices. In particular, it relates to mounts for wearable devices for use in industrial, logistics, and warehouse applications.

BACKGROUND

In modern production environments, such as warehouses and industrial locations, it is increasingly desirable for human operators to be able to wear portable electronic devices for easy access. This is also desirable for other jobs, such as parcel delivery, and for other use cases, such as hobby and recreational environments.

Wearable devices may, for example, be attached on to the wearable mount that is attached to the wrist, hand, or forearm of a user. Latching operations may be carried out multiple times in a work shift (e.g., during breaks or battery replacement). Some applications require that a user make two opposing motions (e.g., pressing a button while also sliding a device downwards and away from the user) and/or are otherwise unintuitive or overly difficult.

Through applied effort, ingenuity, and innovation, Applicant has solved problems relating to ergonomic latching and release of wearable devices by developing solutions embodied in the present disclosure, which are described in detail below.

SUMMARY

In general, embodiments of the present disclosure provide methods, apparatuses, systems, computing devices, computing entities, and/or the like.

Various embodiments of the present disclosure may include a wearable device mounting system. In some embodiments, the system includes a wearable device. In some embodiments, the wearable device includes one of a guide surface and an attachment mechanism and one of a receptor and a latching mechanism. In some embodiments, the latching mechanism includes a release button. In some embodiments, the system further includes a mounting apparatus. In some embodiments, the mounting apparatus includes the other of the guide surface and the attachment mechanism and the other of the receptor and the latching mechanism. In some embodiments, the attachment mechanism is configured to operably engage the guide surface. In some embodiments, the latching mechanism is configured to operably engage the receptor. In some embodiments, the release button is configured to enable operable detachment of the wearable device from the mounting apparatus. In some embodiments, the wearable device is configured to be rotatable relative to the mounting apparatus in an instance in which the latching mechanism and the receptor are disengaged. In some embodiments, the wearable device and the mounting device are configured to be attached to each other in an instance in which, on the one hand, the attachment mechanism and the guide surface are operably engaged and, on the other hand, the latching mechanism and the receptor are operably engaged.

In some embodiments, the mounting apparatus includes a shield plate. In some embodiments, the shield plate is configured to cover at least a portion of the latching mechanism.

In some embodiments, the guide surface and the receptor of the wearable device are disposed on a bottom surface of the wearable device.

In some embodiments, the attachment mechanism and the latching mechanism are disposed on a top surface of the mounting apparatus.

In some embodiments, the attachment mechanism includes a protrusion configured to engage the guide surface, wherein the guide surface defines an orifice configured to receive the protrusion therein.

In some embodiments, the wearable device includes a groove and the attachment mechanism includes a rail mechanism configured to operably engage the groove.

In some embodiments, the top surface of the mounting apparatus includes a curved surface corresponding to the bottom surface of the wearable device. In some embodiments, the bottom surface of the wearable device defines at least a partially curved surface.

In some embodiments, the mounting apparatus includes a plurality of fasteners configured to form a plurality of operable attachment points configured to engage a strap.

In some embodiments, the wearable device includes a battery pack disposed at an opposite side of the guide surface from the receptor.

In some embodiments, the wearable device is configured to be rotatable relative to the mounting apparatus immediately upon disengaging the latching mechanism and the receptor.

In some embodiments, at least a portion of the attachment mechanism and at least a portion of the latching mechanism are configured to protrude out of a surrounding portion of a top surface of the mounting apparatus.

In some embodiments, the guide surface includes one or more angled surfaces configured to guide the attachment mechanism into an engaged position from a plurality of disengaged positions in response to a force by a user.

Various embodiments of the present disclosure may include a mounting apparatus. In some embodiments, the mounting apparatus includes an attachment mechanism. In some embodiments, the mounting apparatus includes a latching mechanism. In some embodiments, the latching mechanism includes a release button. In some embodiments, the attachment mechanism is configured to operatively engage a guide surface of a wearable device. In some embodiments, the latching mechanism is configured to operatively engage a receptor of the wearable device. In some embodiments, the release button is configured to enable operable detachment of the wearable device from the mounting apparatus.

In some embodiments, the attachment mechanism and the latching mechanism are disposed on a top surface of the mounting apparatus.

In some embodiments, the attachment mechanism includes a protrusion configured to engage the guide surface and be received by an orifice of the wearable device.

In some embodiments, the attachment mechanism includes a rail mechanism configured to operably engage a groove of the wearable device.

Various embodiments of the present disclosure may include a method of operably attaching a wearable device to a mounting apparatus. In some embodiments, the method includes aligning the wearable device with the mounting apparatus. In some embodiments, the wearable device includes one of a guide surface and an attachment mechanism and one of a receptor and a latching mechanism. In some embodiments, the wearable device is configured to be rotatable relative to the mounting apparatus in an instance in which the latching mechanism and the receptor are disengaged. In some embodiments, the mounting apparatus includes the other of the guide surface and the attachment mechanism and the other of the receptor and the latching mechanism. In some embodiments, the latching mechanism includes a release button. In some embodiments, the method further includes engaging the attachment mechanism and the guide surface. In some embodiments, the method includes engaging the latching mechanism and the receptor.

In some embodiments, engaging the attachment mechanism and the guide surface occurs simultaneous with engaging the latching mechanism and the receptor.

In some embodiments, engaging the attachment mechanism and the guide surface occurs prior to engaging the latching mechanism and the receptor, wherein the wearable device is rotated relative to the mounting apparatus.

In some embodiments, the method includes a step where one of the wearable device or the mounting apparatus is rotated to engage the receptor and the latching mechanism of the other of the wearable device or the mounting apparatus after engagement of the attachment mechanism and the guide surface.

The above summary is provided merely for purposes of summarizing some example embodiments to provide a basic understanding of some embodiments of the disclosure. Accordingly, it will be appreciated that the above-described embodiments are merely examples. It will be appreciated that the scope of the disclosure encompasses many potential embodiments in addition to those here summarized, some of which will be further described below.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 6A:
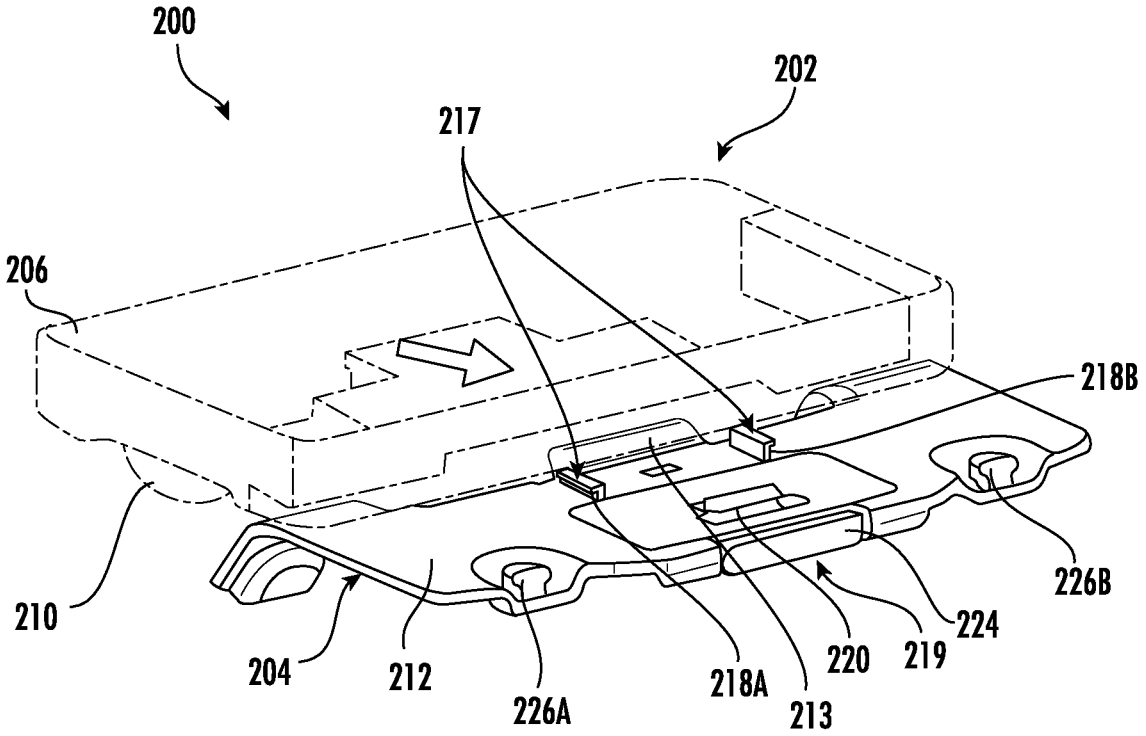
Figure 6B:
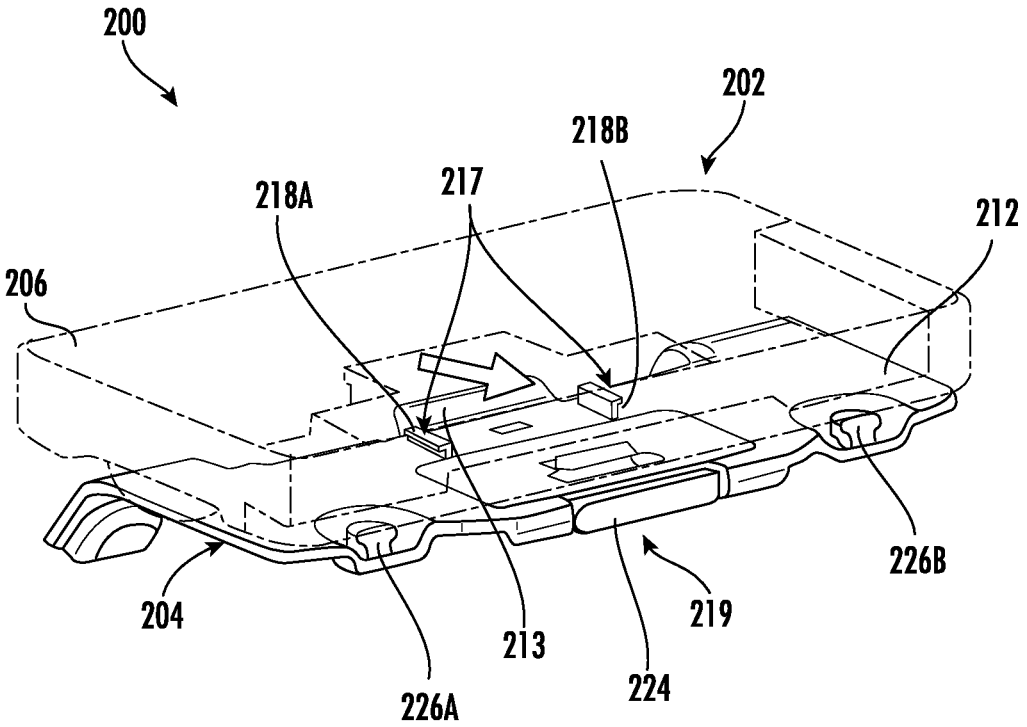
Figure 6C:
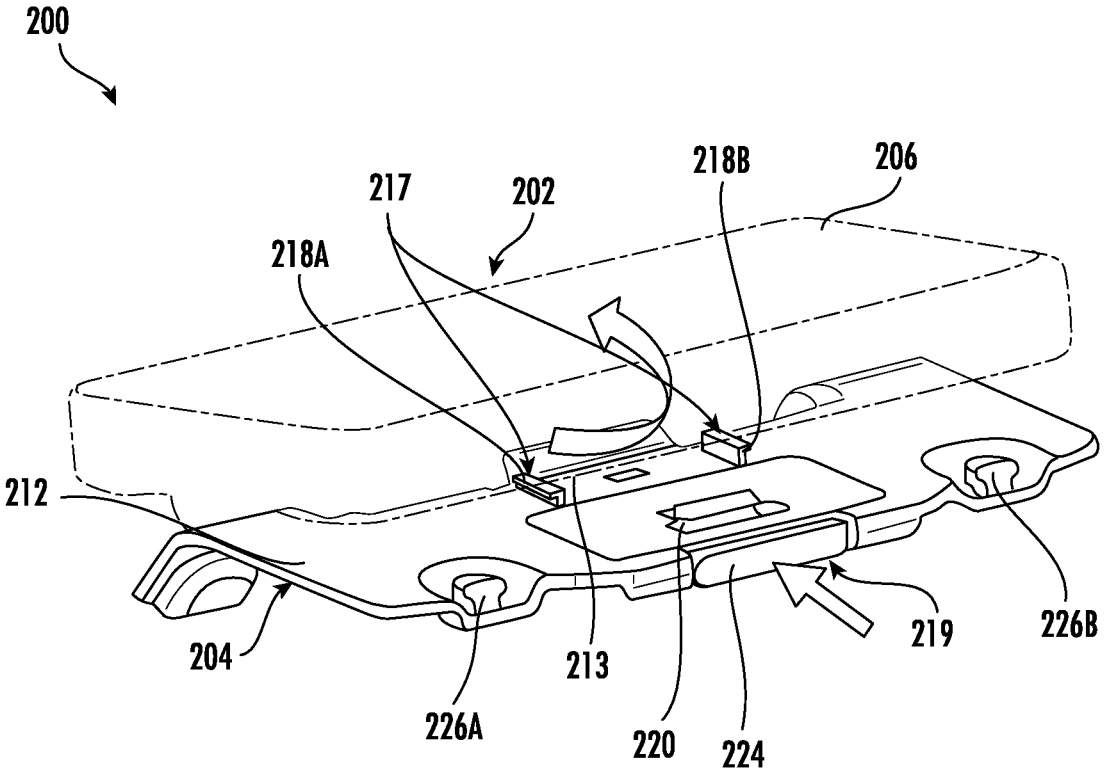
Figure 7:
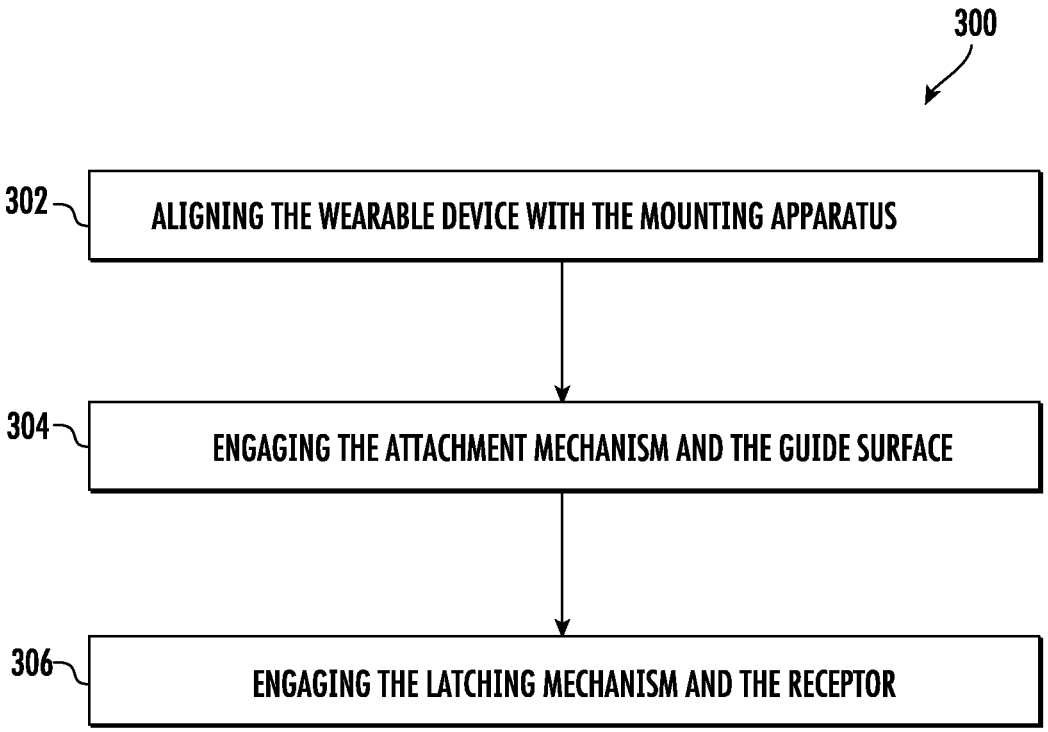
Figure 8:
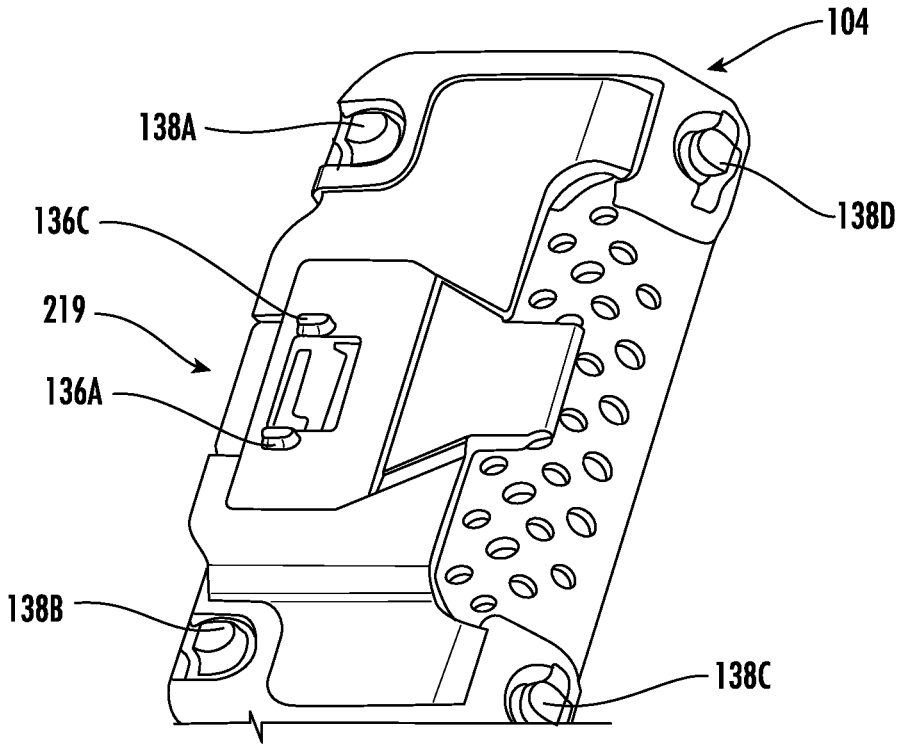

FIGS. 5A, 5B, 5C, and 5D are side perspective views of an example wearable device mounting system with a rail mechanism in accordance with various embodiments of the present disclosure;

FIGS. 6A, 6B, and 6C are isometric perspective views of an example wearable device mounting system with a rail mechanism in accordance with various embodiments of the present disclosure;

FIG. 7 is a flow diagram of an example method for attaching a wearable device to a mounting apparatus that can be performed in accordance with various embodiments of the present disclosure; and FIG. 8 is an angled view of an example wearable device mounting system with a protrusion attachment mechanism in accordance with various embodiments of the present disclosure.

DETAILED DESCRIPTION OF SOME EXAMPLE EMBODIMENTS

Various embodiments of the present disclosure now will be described more fully hereinafter with reference to the accompanying drawings, in which some, but not all embodiments of the disclosure are shown. Indeed, this disclosure may be embodied in many different forms and should not be construed as limited to the embodiments set forth herein; rather, these embodiments are provided so that this disclosure will satisfy applicable legal requirements. The term "or" (also designated as "/") is used herein in both the alternative and conjunctive sense, unless otherwise indicated. The terms "illustrative" and "exemplary" are used to be examples with no indication of quality level. Like numbers may refer to like elements throughout. The phrases "in one embodiment," "according to one embodiment," and/or the like generally mean that the particular feature, structure, or characteristic following the phrase may be included in at least one embodiment of the present disclosure and may be included in more than one embodiment of the present disclosure (importantly, such phrases do not necessarily refer to the same embodiment).

Overview

Many individuals employed in a variety of occupations and other users operating in nearly any environment where their hands must be available for use may be attach and un-attaching wearable devices to a wearable mounting apparatus multiple times throughout the workday. Latching may be limited by, for example, a battery that protrudes or "bumps out" from the device that is being inserted into the mount. Additionally, users may experience difficulties when ejecting a device from a wearable device's mount if the mount requires overly complex or counterintuitive motions. Typical examples include workers in warehouses and other industrial centers. However, a similar requirement may apply to parcel deliverers or any other user desiring a handsfree operation of a wearable device. It will be understood that many other workers and users may have such requirements.

Various embodiments of the present disclosure are directed to a wearable device mounting system that intuitively and efficiently facilitates engagement and disengagement between a wearable device and a mounting apparatus, where the mounting apparatus may be able to strap or otherwise attach to a user's body or another mounting structure. Some engagement mechanisms, such as long sliding channels, may require a user to slide the wearable device linearly along the entire length of a channel for both engagement and disengagement. In some situations, to disengage the wearable device, a button or lever may be pressed that is not in a same direction as the removal direction of the channel, which may be counterintuitive and difficult for a user to operate. An elongated channel may generally define a narrow, precise path that is inefficient and time consuming to follow during normal use and may lead to binding or other inefficiencies during disengagement and engagement.

The present disclosure provides various embodiments of a wearable device and a mounting apparatus that provide quick, forgiving, and efficient alignment. Various embodiments also allow a rotational degree of freedom and quick release ejection via a release button that operates in the same direction or an intuitive adjacent direction. For example, in some embodiments, the alignment may be carried out by a guide surface that includes angled surfaces configured to help align an attachment mechanism (e.g., a protruding, diving-board-shaped hook) during insertion. The angled surfaces (e.g., ribs, recesses, or other laterally engaging structures) may be on both sides of the guide surface and may allow enough tolerance in lateral direction and the attachment mechanism may extend sufficiently far to allow larger tolerance in the insertion angle of the wearable device. These features may allow blind insertion of the wearable device on the mounting apparatus while wearing on the arm or another mounting structure. In some embodiments, a short, rail attachment mechanism may be used that allows sliding engagement between the mounting apparatus in the wearable device while also allowing rotational engagement and disengagement when the rail mechanism and a corresponding groove move past each other. In various embodiments, the wearable device may be efficiently and intuitively ejected by pushing a release button and rotating the wearable device out of engagement with the mounting apparatus. For example, the attachment mechanism may pivot relative to, and in some instances within, the guide surface in an instance in which a release button disconnects two other engaging structures (e.g., a peg and latching mechanism as described herein). The rotational motion may offer improved performance and intuitiveness because it may promote operation in the same direction motion of pressing the button and removal of the device.

Various embodiments are described below that attempt to facilitate the speedy and ergonomic attachment and unattachment of example wearable devices to example mounting apparatuses, including but not limited to a protrusion attachment mechanism and a sliding rail attachment mechanism. Unless expressly stated otherwise or unless physically incompatible, the various features of the various embodiments herein may be combined individually or in any sub-combination or combination of features.

Wearable Device Mounting System with Protrusion Attachment Mechanism

According to some embodiments, and as shown in at least FIGS. 1-4, a system 100 may include a wearable device 102 and a mounting apparatus 104. In some embodiments, the wearable device 102 may be a computer, cellular phone, tablet, personal digital assistant (PDA), or any other electronic device capable of being carried by a user. In some embodiments, the mounting apparatus 104 may be secured to a user or another attachment structure via a strap (not shown) or another mechanism capable of securely attaching to a structure (e.g., a user's arm or another body part or inanimate structure). In some embodiments, the strap may be an integral part of the mounting apparatus or a separately attached component. In various embodiments, other mounting hardware (e.g., plates, screws, stands, or the like) may be used. As shown in FIGS. 1-4, according to various embodiments, the wearable device 102 may be removably attached to the mounting apparatus 104 for securing the wearable device during operation while facilitating intuitive and efficient removal when necessary. Reference is made below to the examples shown in FIGS. 1-4. However, it will be understood that a wearable device mounting system making use of a protrusion attachment mechanism is not limited to the examples described below or shown in FIGS. 1-4.

Figure 1:
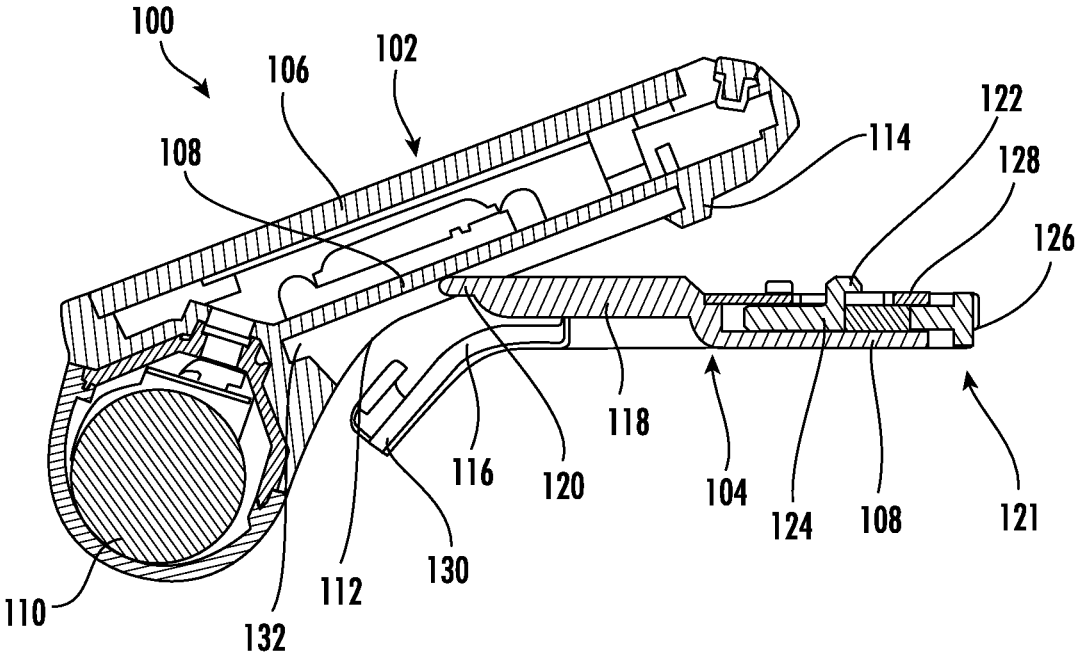
FIG. 1 is a first side view of an example wearable device mounting system with a protrusion attachment mechanism in accordance with various embodiments of the present disclosure.
Figure 2:
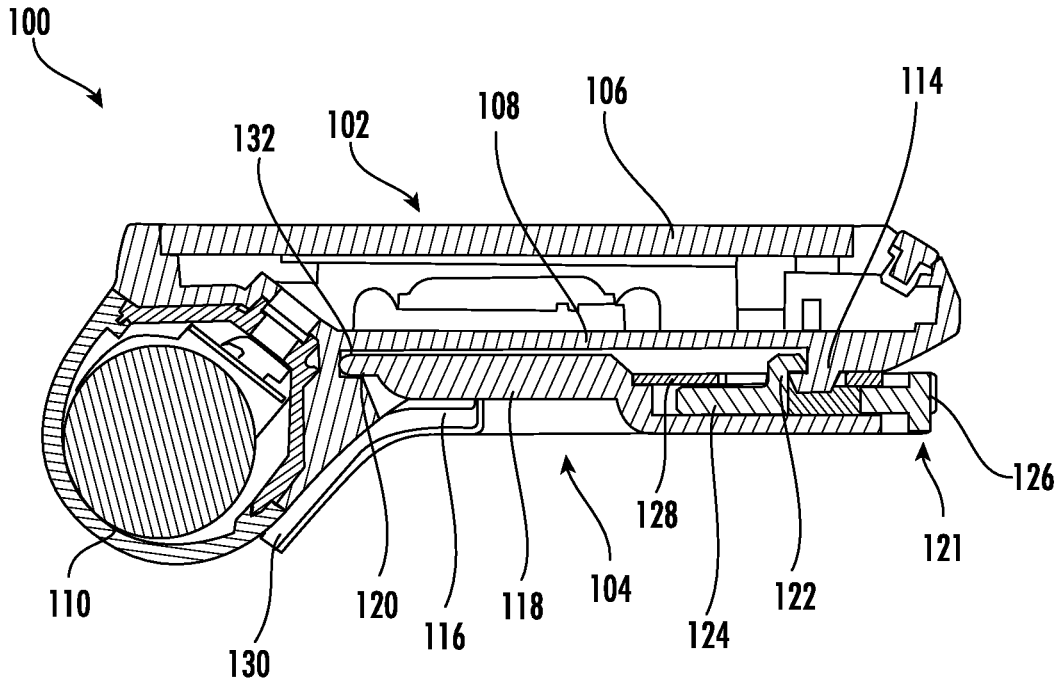
FIG. 2 is a second side view of an example wearable device mounting system with a protrusion attachment mechanism in accordance with various embodiments of the present disclosure.
Figure 3:
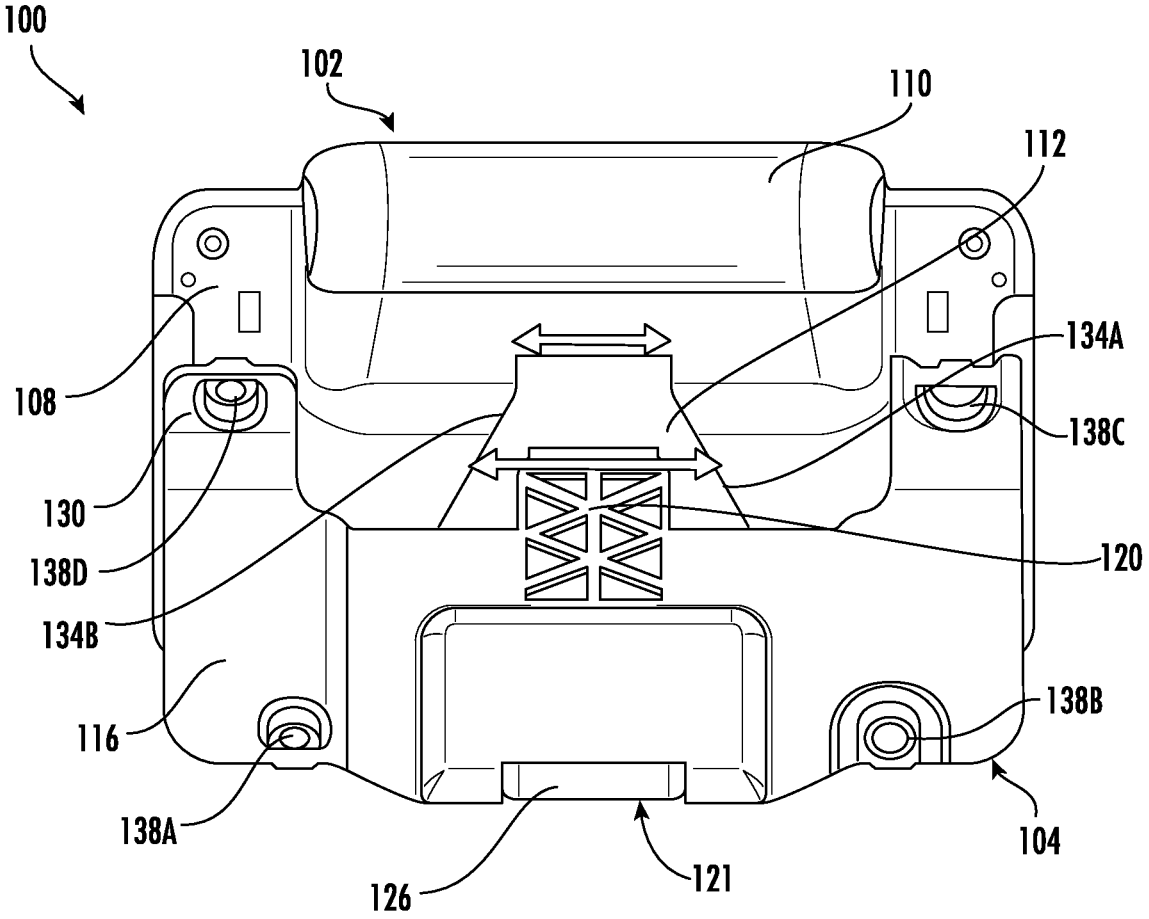
FIG. 3 is a bottom view of an example wearable device mounting system with a protrusion attachment mechanism in accordance with various embodiments of the present disclosure.
Figure 4:
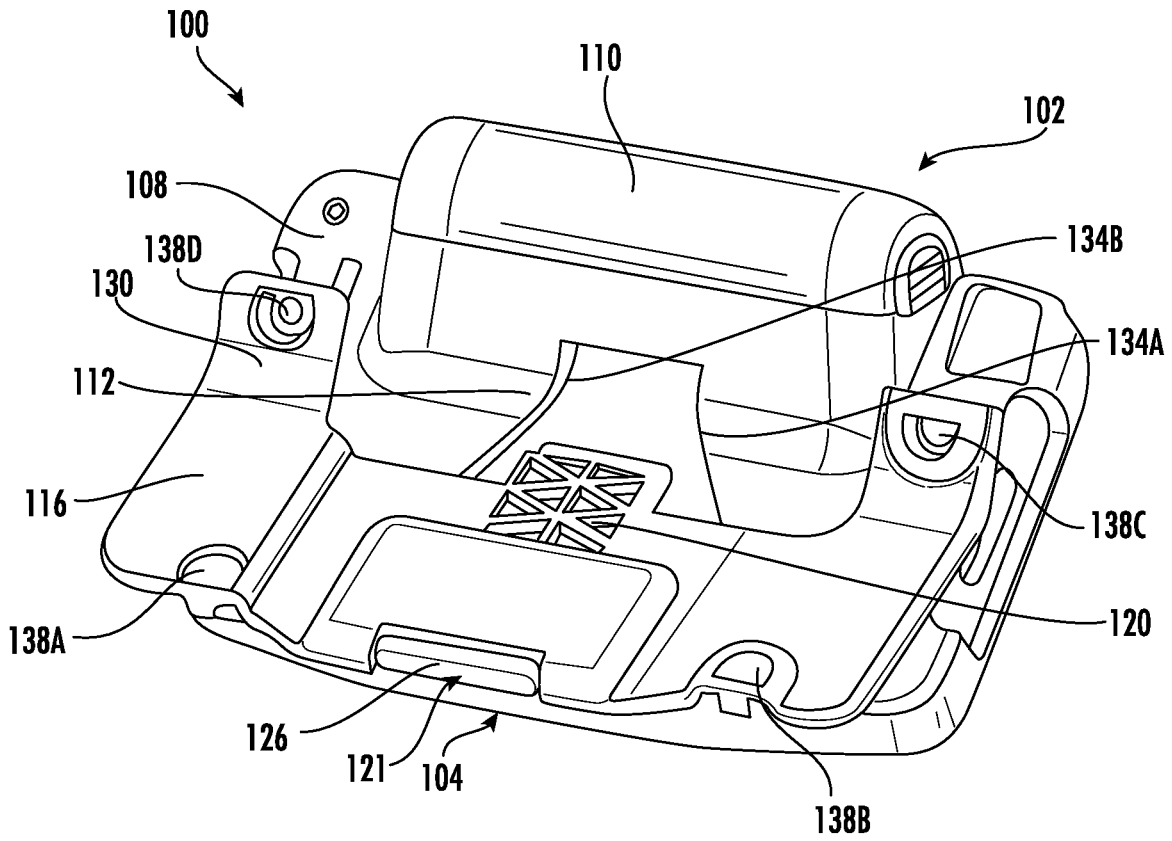
FIG. 4 is a bottom perspective view of an example wearable device mounting system with a protrusion attachment mechanism in accordance with various embodiments of the present disclosure.

FIGS. 1 and 2 show side views of an example wearable device mounting system 100. FIG. 3 is a bottom view of an example wearable device mounting system 100 with a protrusion attachment mechanism 120 that can be used in accordance with various embodiments of the present disclosure. FIG. 4 is a perspective view of an example wearable device mounting system 100 with a protrusion attachment mechanism 120 that can be used in accordance with various embodiments of the present disclosure.

FIG. 1 shows the wearable device 102 disconnected from the mounting apparatus 104, according to some embodiments. In some embodiments, the wearable device 102 may have a top surface 106 and a bottom surface 108. In some embodiments, the top and bottom surfaces 106, 108 may be substantially flat. In other embodiments, the top and bottom surface 106, 108 may have an at least partially curved shape. In some embodiments, the wearable device 102 may also have a battery pack 110, which in some embodiments may be detachable from the wearable device 102. The battery pack 110 may be disposed at one extreme side of the wearable device (e.g., as shown in FIG. 1), with the guide surface 112 being shown disposed between the battery pack 110 and the receptor 114. In such embodiments, the battery pack 110 may at least partially balance the wearable device 100 relative to the guide surface 112 and the corresponding attachment mechanism (e.g., protrusion 120) of the mounting apparatus 104, such that the wearable device rotates efficiently about the attachment mechanism (e.g., protrusion 120) in an instance in which the mounting apparatus 104 is held level with the ground.

In some embodiments, the mounting apparatus 104 may have an attachment mechanism, which may include protrusion 120 that, in some embodiments, may be connected to the top surface 118 or otherwise accessible to the wearable device. In some embodiments, the protrusion 120 of the mounting apparatus 104 may be a molded piece of the top surface 118. It will be understood that the protrusion 120 may be integrated with the mounting apparatus 104 in a variety of manners to ensure proper functioning of the system 100. In some embodiments, the protrusion 120 may be, for example, a hook or another similar structure capable of engaging and at least partially limiting the degrees of freedom of movement of the wearable device, alone or in combination with the latching mechanism described herein. In some embodiments, the protrusion 120 may be, for example, a diving board or other board-shaped structure.

In some embodiments, the wearable device 102 may also have a guide surface 112 defined on its bottom surface 108. In some embodiments, the guide surface 112 may be configured to connect or "lock in" the wearable device 102 onto the mounting apparatus 104 as well as to guide the wearable device 102 into this connected or locked-in state. In some embodiments, the guide surface 112 may include an orifice 132. In some embodiments, the orifice 132 may be configured to receive the protrusion 120 of the mounting apparatus 104, with the orifice defining an open side and five closed sides to prevent relative movement between the protrusion 120 and the wearable device in an instance in which the latching mechanism and receptor (discussed herein) are also engaged to prevent the protrusion from backing out of the orifice.

In some embodiments, as shown in at least FIGS. 3 and 4, the guide surface 112 may also include a plurality of lateral alignment surfaces 134A, 134B. In some embodiments, the alignment surfaces 134A, 134B may be configured to assist in guiding the protrusion 120 into the orifice 132 in the lateral direction (e.g., into and out of the page in the view shown in FIG. 1) in an instance in which the protrusion 120 is not laterally aligned with the orifice 132. The alignment surfaces may define a taper that gradually feeds the protrusion 120 into the orifice 132, with a distance between the alignment surfaces 134A, 134B narrowing as the protrusion approaches the orifice as illustrated in FIG. 3. An example of this tapering is indicated at least by the arrows shown in FIGS. 3 and 4. In some embodiments, the guide surface 112 secures the wearable device 102 to the mounting apparatus 104 and restricts at least one degree of freedom of the wearable device 102 relative to the mounting apparatus 104. A combination of the latching mechanism and receptor (also discussed herein) with the guide surface and alignment mechanism may collectively reduce all degrees of freedom of movement between the wearable device and the mounting apparatus.

In some embodiments, the wearable device 102 may have a receptor 114 attached to and/or integrated with its bottom surface 108. In some embodiments, the receptor 114 may be configured to make an operable connection to the mounting apparatus 104, such as via a latching mechanism 121. In some embodiments, the receptor 114 may be, for example, a peg, as shown in at least FIGS. 1-2. However, the receptor 114 may, for example, be any shape or component configured to make an operable connection to the mounting apparatus 104; for example, in some embodiments, the receptor 114 may be an orifice, opening, recess, ledge, or other feature defined in the bottom surface 108 capable of preventing the wearable device from lifting vertically off the top surface of the mounting apparatus in an instance in which the latching mechanism and protrusion are engaged with the wearable device. In some embodiments, the guide surface 112 and the attachment mechanism (e.g., protrusion 120) may engage from a first direction while the receptor 114 and latching mechanism engage from a second direction (e.g., from the left and right relative to the perspective of FIG. 2) to hold the wearable device 102 in opposing directions to prevent removal without first actuating a release button 126 to disconnect the latching mechanism 121 from the receptor 114. In some embodiments, the guide surface 112 may include a ramped surface.

In some embodiments, the mounting apparatus 104 may have a bottom surface 116 and a top surface 118. In some embodiments, the bottom and top surfaces 116, 118 may be flat, but in other embodiments they may be curved or may otherwise define one or more complementary shapes with the wearable device. It will be understood that the shape of the top and bottom surfaces 116, 118 of the mounting apparatus 104 may be configured in some embodiments to conform to the respective surfaces 106, 108 of the wearable device 102. In some embodiments, the bottom surface 116 may curve inwardly on itself. It will be understood that the bottom surface 116 may be curved as desired by a user and/or to accommodate and support the wearable device 102.

In some embodiments, the mounting apparatus 104 may include a latching mechanism 121. In some embodiments, the latching mechanism 121 may include a latch 122 connected to and/or integrated with a latch base 124. In some embodiments, the latch 122 may be operated by means of a release button 126 that, in some embodiments, may be connected and/or integrated with the latch base 124. In the depicted embodiment of FIG. 2, the latching mechanism 121 may be spring-loaded and urged towards a right side of the figure, causing the latching mechanism 121 to tend to engage the receptor 114 unless the release button 126 is actuated in a leftward direction to act against the spring force. In some embodiments, the latching mechanism 121 may be engaged automatically with the receptor 114 when the protrusion 120 is oriented toward the orifice 132 and the wearable device is pushed down onto the latching mechanism. The release button may automatically actuate in response to the downward force of the wearable device on the latch 122, and in some embodiments, the release button 126 may only require actuation by a user to release the wearable device. In some embodiments, the spring force of the latching mechanism 121 may aid in preventing inadvertent detachment of the wearable device 102 from the mounting apparatus 104 in the event that, for example, the wearable device 102 and/or the mounting apparatus 104 is impacted.

In some embodiments, the latch base 124 may be covered by a shield plate 128 that is removably attached to the top surface 118 of the mounting apparatus 104. In some embodiments, the shield plate 128 may protect the latch 122 from interference and/or damage by a user. In some embodiments, the shield plate 128 may also protect the latch 122 from inadvertently being triggered by a user during a non-ideal time (i.e., when the user does not want to disconnect the wearable device 102 from the mounting apparatus 104). In some embodiments, the shield plate 128 may be removable to service or replace the latching mechanism 121. The latching 122 may comprise a hook shape configured to engage the receptor 114 as described herein.

In some embodiments, the bottom surface 116 may include a hooked end 130 that, in some embodiments, may be disposed at the distal end of the bottom surface 116; that is, in some embodiments, the hooked end 130 may be disposed on the opposite end of the bottom surface 116 from the latch base 124. The hooked end 130 may be configured, for example, to support at least a portion of the wearable device, such as the battery pack 110 as shown in FIG. 2.

According to some embodiments, FIG. 1 may illustrate either the wearable device 102 immediately prior to being attached to the mounting apparatus 104 (e.g., by means of the latch 122 snapping into engagement with the receptor 114), or in the process of being un-attached from the mounting apparatus 104 (e.g., by means of the release button 126). In the depicted embodiment, the wearable device 102 may be attached to the mounting apparatus 104 by engaging the protrusion 120 with the guide surface 112 and subsequently pivoting the wearable device 102 until the latch 122 snaps into engagement with the receptor 114. Alternatively, the wearable device 102 may be attached to the mounting apparatus 104 by translationally sliding the wearable device 102 along the top surface 118 of the mounting apparatus 104 until both the protrusion 120 and the latch 122 engage their respective counterpart guide surface 112 and receptor 114, inserting from the same direction. During removal, the user may push the release button 126 while simultaneously lifting the receptor 114 clear of the latch 122 in at least partially the same direction, such that the wearable device can be removed single handed. In some embodiments, during removal, the user may rotate the wearable device 102 after pushing the release button 126. The guide surface 112 may facilitate repeatable and intuitive connection between the wearable device and the mounting apparatus without requiring the user to precisely align the components prior to engagement, and in embodiments where the latch 122 engages the receptor 114 subsequent to engagement of the guide surface 112 and the attachment mechanism (e.g., protrusion 120), the latch 122 may already be aligned with the receptor 114 by virtue of the guide surface 112 already aligning the orifice 132 with the protrusion 120.

In some embodiments, the features of the wearable device 102 and the mounting apparatus 104 may be interchanged. For example, in some embodiments, the guide surface and receiving orifice 112, 132 and/or the receptor 114 may be placed on the mounting apparatus 104 as opposed to the wearable device 104, and the protrusion 120 and/or the latch mechanism 121 may subsequently be disposed on the wearable device 102.

According to some embodiments, the features described above with respect to at least FIGS. 1, 2, 3, and 4 may allow for "blind insertion" of the wearable device 102 to the mounting apparatus 104 while the mounting apparatus 104 is being worn by a user. It will be understood that the mounting apparatus 104 may be worn in a variety of locations on a user (e.g., on a user's arm, on a user's belt, etc.). It will be further understood that, in some embodiments, the mounting apparatus 104 may be placed on a structure near a user (e.g., on a forklift, on a vehicle dashboard, etc.). In some embodiments, the system 100 may allow a rotational degree of freedom and quick release ejection in the same direction (i.e., by means of the release button 126).

In some embodiments, and as shown in at least FIG. 8, the mounting apparatus 104 may include a plurality of keyed features 136A, 136B. In some embodiments, these keyed features 136A, 136B may be bump-outs or other alignment features that protrude from the mounting apparatus 104 to engage corresponding openings in the wearable device. In some embodiments, the keyed features 136A, 136B may further enable the alignment of the receptor 114 with the latch 122. That is, in some embodiments, the keyed features 136A, 136B may limit or prevent the receptor 114 from sliding too far left or right as the wearable device 102 is operably attached to the mounting apparatus 104 by aligning the wearable device with the mounting apparatus. In some embodiments, the keyed features 136A, 136B may aid in preventing the wearable device 102 from being inadvertently detached from the mounting apparatus 104 in the event that, for example, the wearable device 102 and or the mounting apparatus 104 is impacted by requiring the wearable device to be lifted vertically off the mounting apparatus for removal.

In some embodiments, as shown in at least FIG. 8, the mounting apparatus 104 may have a plurality of fasteners 138A, 138B, 138C, and 138D, into which one or more straps may engage to secure the mounting apparatus 104 to a user's wrist (e.g., as part of a strap). Similar fasteners straps may be used with the embodiment of FIGS. 5A-6C.

Wearable Device Mounting System with Slide Rail Attachment Mechanism

FIGS. 5A, 5B, 5C, and 5D are side perspective views of an example wearable device mounting system 200 with a rail mechanism 217 that can be used in accordance with various embodiments of the present disclosure. Unless described otherwise, the various benefits and operational use cases of the embodiments of FIGS. 1-4 would also apply equally to the embodiments of FIGS. 5A-6C. In some embodiments the rail mechanism 217 and corresponding features may be used in addition to and in conjunction with the engagement features of the embodiments of FIGS. 1-4. According to some embodiments, the system 200 includes a wearable device 202 and a mounting apparatus 204. In some embodiments, the wearable device 202 has a top surface 206 and a bottom surface 208. In some embodiments, the bottom surface 208 may be at least partially curved. In some embodiments, the wearable device 202 includes a battery pack section 210. In any of the various embodiments herein, the battery pack section 210 may be disposed on a side of the wearable device 202 that is opposite a receptor 209 relative to a guide surface 211 (e.g., the pivot location may be between the battery pack section 210 and the latching location of the wearable device 202) in a similar manner to the embodiment of FIGS. 1-4. In some embodiments, the receptor 209 may be a peg. In other embodiments, the receptor 209 may be an orifice, shelf, recess, or any other feature capable of engaging the latch mechanism in the same manner as the embodiment of FIGS. 1-4. In some embodiments, the guide surface 211 may comprise a ramped surface.

In some embodiments, the mounting apparatus 204 includes a top surface 212 and a bottom surface 214. In some embodiments, the top surface 212 may be curved into a shape to accommodate, for example, the bottom surface 208 of the wearable device 202. In some embodiments, the mounting apparatus 204 may have a plurality of fasteners 226A,226B, 226C, and 226D, into which one or more straps may engage to secure the mounting apparatus 204 to a user's wrist. Similar fasteners may be used with the embodiment of FIGS. 1-4 and are described in the corresponding section.

In some embodiments, as shown in at least FIGS. 5A, 5B, 5C, and 5D, the wearable device 202 includes a groove 216. In some embodiments, the groove 216 may be disposed on a guide surface 211, which guide surface may engage a corresponding attachment mechanism 213 (e.g., a protrusion) of the mounting apparatus 204. In some embodiments, the attachment mechanism 213 may operate in a similar manner to the attachment mechanism described above with respect to the embodiment of FIGS. 1-4, whereby a protrusion enters an orifice 230 of the guide surface 216 to reduce the degrees of freedom of movement of the wearable device relative to the mounting apparatus. The guide surface 211 may be similarly sloped and/or laterally tapered towards the orifice 230.

In some embodiments, the grooves 216 may align with the slope of the guide surface 211. In some embodiments, the grooves 216 are configured to fit onto a rail mechanism 217. In some embodiments, the rail mechanism 217 may include a plurality of rails 218A, 218B. In some embodiments, the plurality of rails 218A, 218B may be disposed on the mounting apparatus 204. In some embodiments, the grooves 216 are a part of and/or integrated with the bottom surface 208 of the wearable device 202. In some embodiments, the plurality of rails 218A, 218B are only partial rails extending along a portion of the travel distance of the wearable device relative to the mounting structure, which may allow the wearable device 202 to be rotated and released as required. For example, in the embodiment depicted in FIGS. 5A-5D, the grooves 216 extend along a portion of the bottom surface 208 at least a portion of the distance between the receptor 209 and the orifice 230 of the guide surface 211. In the depicted embodiment, the grooves 216 terminate at least a length of the rails 218A, 218B short of the orifice 230 such that the rails can pivot free of the grooves 216 at least during disconnection of the wearable device and mounting surface without the rails having to travel back along the grooves. In some embodiments, the rails 218A, 218B and groove 216 may guide the wearable device 202 translationally until the wearable device 202 reaches an engagement location or a predetermined distance from an engagement location (e.g., engagement between the attachment mechanism 213 and orifice 230 of the guide surface 211), at which point the rails 218A, 218B and grooves 216 separate (e.g., via the partial rail) and an attachment mechanism 213 engages a guide surface 211 while a latching mechanism 219 engages a receptor 209 similar to the embodiment of FIGS. 1-4.

In some embodiments, and as shown in FIGS. 5A, 5B, 5C, and 5D, the wearable device 202 may be inserted into the mounting apparatus 204 translationally by means of the groove 216 sliding onto the plurality of rails 218A, 218B. In some embodiments, multiple rails 218A, 218B may be used to engage multiple grooves 216 facing in opposing directions with the grooves and rails all extending in the translational direction of travel to prevent lateral separation between the wearable device 202 as shown in FIGS. 6A-6C.

In some embodiments, the wearable device 202 may be removably attached to the mounting apparatus 204 by means of a latch mechanism 219, which may engage a receptor 209 on the wearable device in the same manner as the embodiment of FIGS. 1-4. In some embodiments, the latch mechanism 219 may include a latch 220 connected to and/or integrated with a latch base 222. In some embodiments, the latch 220 may be operated by means of a release button 224 that, in some embodiments, may be connected and/or integrated with the latch base 222. The latch mechanism 219 may be spring-loaded to urge the latch 222 into engagement with the receptor 209. In some embodiments, the attachment mechanism 213 and/or the plurality of rails 218A, 218B may move the device 202 upwards and above the latch 220 such that the latch 220 "locks" downwardly into the device 202 as shown in FIG. 5C and secures the device 202 to the mounting apparatus 204. That is, in some embodiments, when the groove(s) 216 move past the plurality of rails 218A, 218B, the grooves 216 and rails 218A, 218B disconnect, and the device 202 subsequently is secured to the mounting apparatus 204 as both the latch and protrusion engage the respective receptor and orifice. In some embodiments, the rails 218A, 218B may be elevated to further enable the device 202 to move upwards and above the latch 220 as the device 202 slides on the rails 218A, 218B, and in some instances, the rails may disconnect from the corresponding groove to allow the wearable device to lower towards the top surface of the mounting apparatus after moving above the latch 220. In some embodiments, a ramp 232 may be disposed on the mounting device 204 to further enable the device 202 to move upwards and above the latch 220 as the device 202 slides on the rails 218A, 218B.

FIGS. 6A, 6B, and 6C are isometric perspective views of an example wearable device mounting system 200 with a rail mechanism 217 that includes a plurality of rails 218A, 218B that can be used in accordance with various embodiments of the present disclosure. It will be understood that, as shown in FIGS. 6A-6C, the wearable device 202 is shown as having a degree of transparency for descriptive purposes and to more fully show the features described in this disclosure. Though, in some embodiments, the wearable device 202 may have a degree of transparency.

Figure 5A:
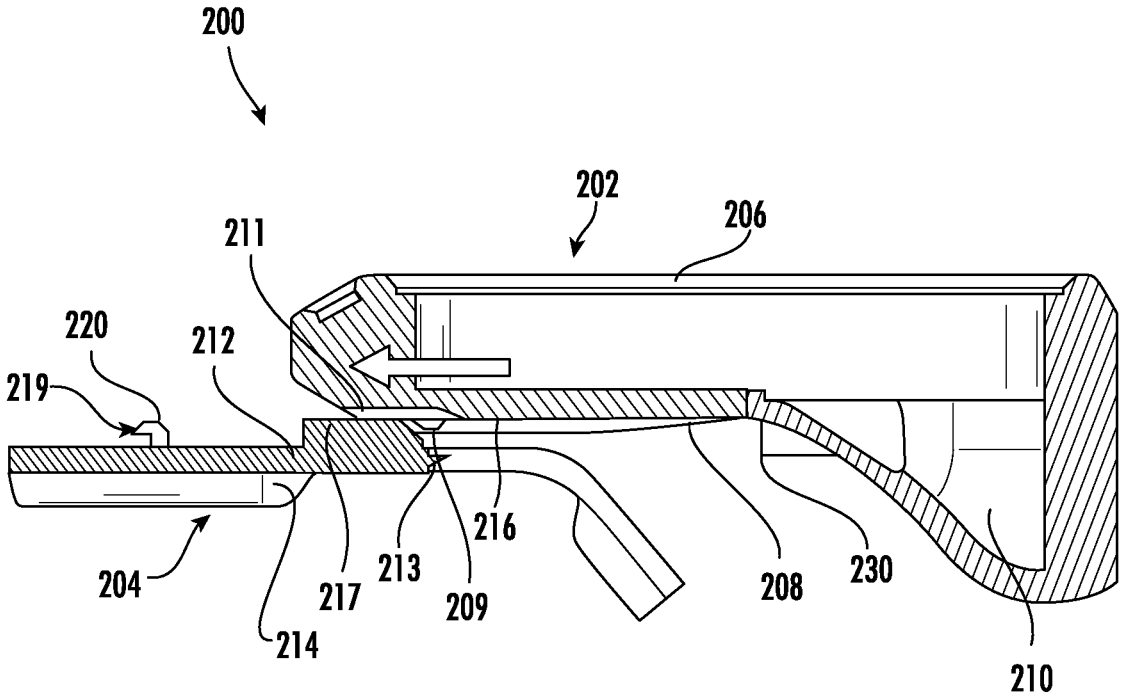
Figure 5B:
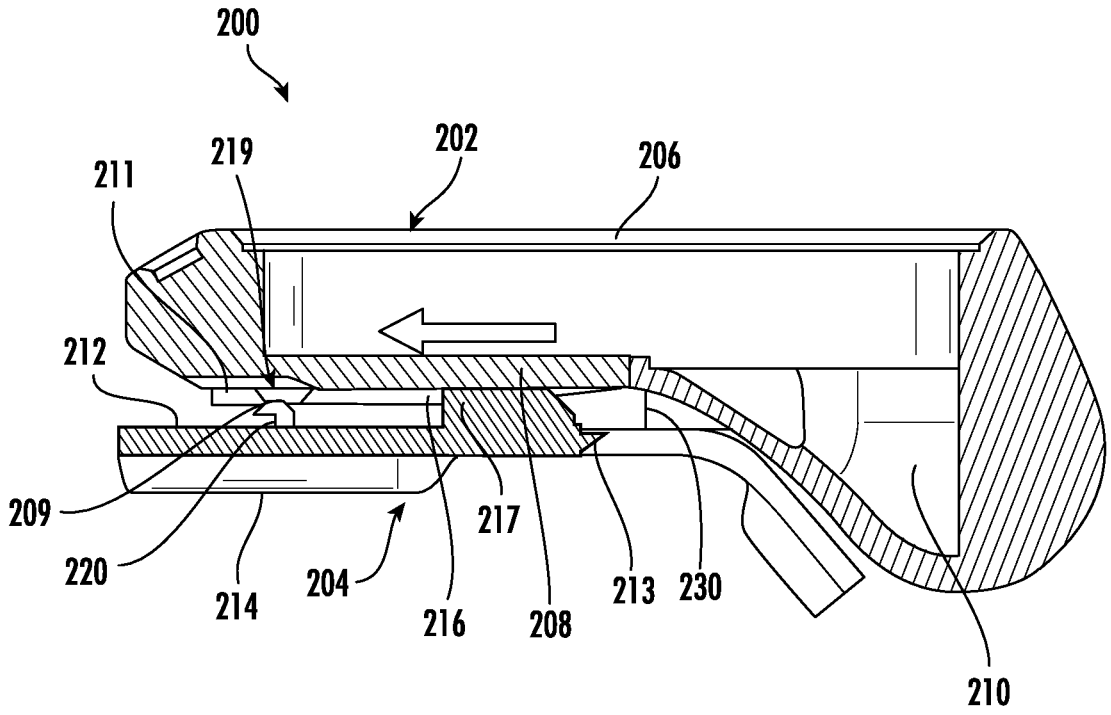
Figure 5C:
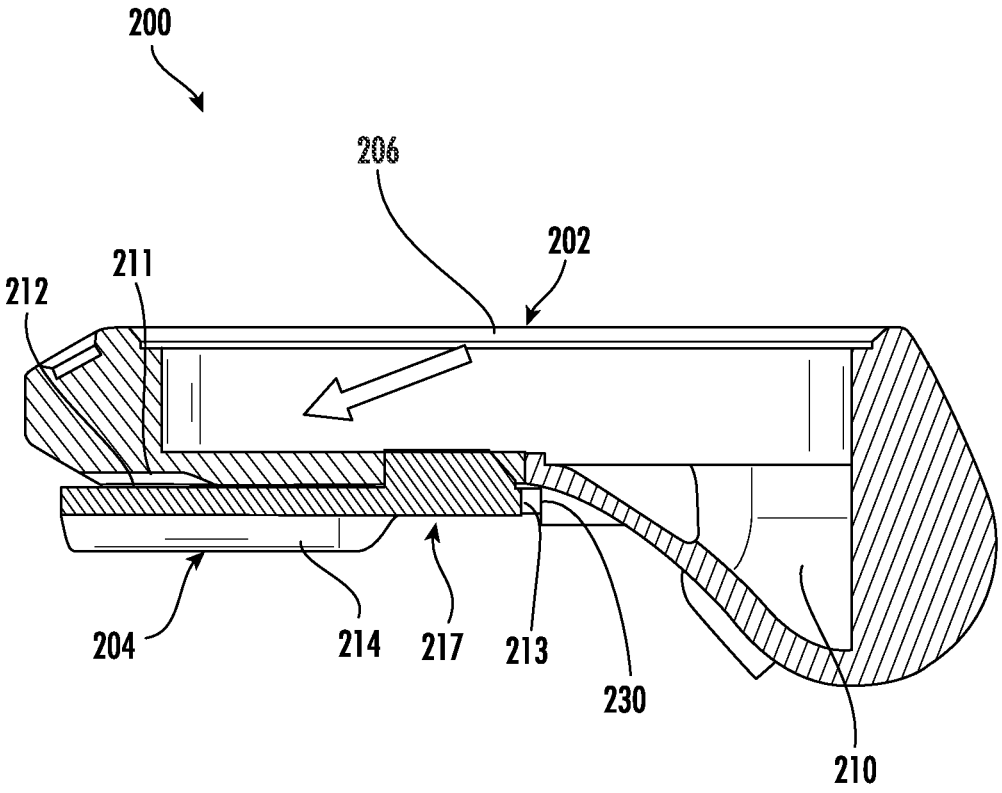
Figure 5D:
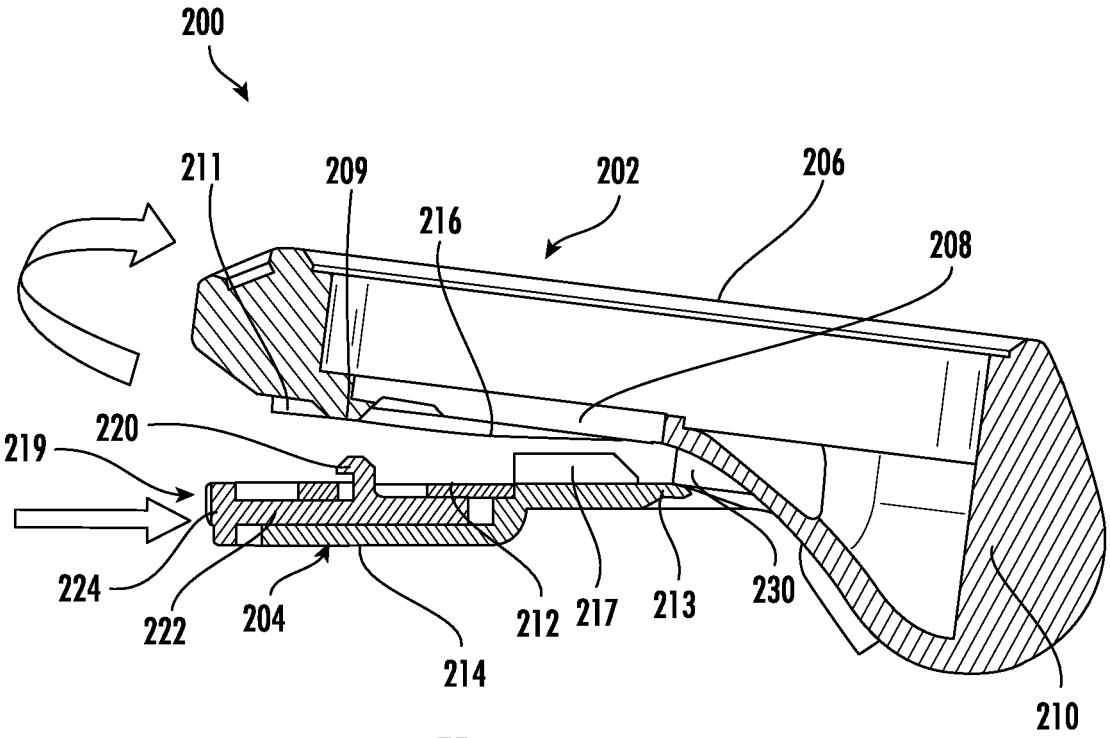

In some embodiments, and as shown in FIGS. 5A, 5B, 5C, and 5D and FIGS. 6A, 6C, and 6C, arrows are diagrammed to show the motion of the device 202 onto the mounting apparatus 204. For example, as shown in FIGS. 5A and 6A, in some embodiments, the wearable device 202 is slidably connected to the mounting apparatus 204. As shown in FIGS. 5B, in some embodiments, the latch 220 of the mounting apparatus 204 is removably connected to the wearable device 202. As shown in FIGS. 5C and 6B, in some embodiments, the wearable device 202 is pressed into the mounting apparatus 204 (e.g., by a user) and thereby removably connected to the mounting apparatus 204. As shown in FIGS. 5D and 6C, in some embodiments, the wearable device 202 is removed from the mounting apparatus 204 by means of pressing the release button 224 of the latch 220, thereby disconnecting the wearable device 202 from the mounting apparatus 204. In some embodiments, the wearable device 202 may be attached to the mounting apparatus 204 by engaging the attachment mechanism 213 with the guide surface 211 (e.g., via orifice 230) and subsequently pivoting the wearable device 202 until the latch 220 snaps into engagement with the receptor 209, bypassing the rail mechanism. In some embodiments, as shown in at least FIGS. 6A-6C, the attachment mechanism 213 may protrude from the top surface 212 of the mounting apparatus. In some embodiments, the attachment mechanism 213 may be configured to be inserted into an orifice located on the guide surface 211. Alternatively or additionally, the wearable device 202 may be attached to the mounting apparatus 204 by translationally sliding the wearable device along the top surface 206 of the mounting apparatus (e.g., using the rail(s) and groove(s)) until the aforementioned features engage, inserting from the same direction). In some embodiments, the wearable device 202 may be rotatable relative to the mounting apparatus 204 immediately upon disengaging the latching mechanism 219 and the receptor 209. In some embodiments, the attachment mechanism 213 may be higher or lower on the top surface 206 of the mounting apparatus 204 to, among other things, correspond to a respective higher or lower position of the orifice on the guide surface 211.

Example Methods of Operably Attaching and Detaching Example Wearable Devices from Example Mounting Apparatuses FIG. 7 is a flow diagram of an example method for attaching a wearable device to a mounting apparatus that can be used in accordance with various embodiments of the present disclosure.

The attachment methods described below are primarily in reference to the systems and apparatuses described above and shown in relation to at least FIGS. 1, 2, 3, 4, 5A, 5B, 5C, 5D, 6A, 6B, and 6C. However, it will be understood that the methods described below may be performed on other suitable systems and apparatuses.

In some embodiments, and as shown in FIG. 7, a method 300 is provided for operably attaching a wearable device (e.g., 102, 202) to a mounting apparatus (e.g., 104, 204). In some embodiments, step 302 may include aligning the wearable device (e.g., 102, 202) with the mounting apparatus (e.g., 104, 204). In some embodiments, step 302 may include positioning the wearable device in relation to the mounting device such that the attachment mechanism is configured to contact at least a portion of the guide surface. In some embodiments, step 304 may include engaging the attachment mechanism and the guide surface. In some embodiments, step 304 may include sliding the rail mechanism of the mounting apparatus into the groove of the wearable device and/or sliding the attachment mechanism along the guide surface until the protrusion and orifice engage. In some embodiments, step 306 may include engaging the latching mechanism and the receptor. In some embodiments, an additional step may include releasing the wearable device from the mounting apparatus by means of the latch release button. In some embodiments, a user may depress the latch release button and slide the wearable device off of the rail of the mounting apparatus. In some embodiments, a user may depress the latch release button and detach the wearable device from the mounting apparatus.

It will be understood that, in some embodiments, the steps 302, 304, 306 may be performed in a variety of orders and sequences. For example, in some embodiments, the second attachment point may be secured before the first (i.e., step 306 may be performed before step 304).

Many modifications and other embodiments of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A mounting apparatus, the mounting apparatus comprising an attachment mechanism, and a latching mechanism, the latching mechanism comprising a release button, wherein the attachment mechanism is configured to operatively engage a guide surface of a wearable device, wherein the latching mechanism is configured to operatively engage a receptor of the wearable device, wherein the release button is configured to enable operable detachment of the wearable device from the mounting apparatus, and wherein the attachment mechanism comprises a rail mechanism configured to guide the wearable device during attachment of the wearable device with the mounting apparatus, and wherein the rail mechanism is configured to disengage from the wearable device based on the attachment of the wearable device to the mounting apparatus.

2. The mounting apparatus of claim 1, wherein the attachment mechanism and the latching mechanism are disposed on a top surface of the mounting apparatus.

3. The mounting apparatus of claim 1, wherein the wearable device comprises a groove, wherein the rail mechanism is configured to operably engage the groove.

4. A wearable device mounting system comprising:

a wearable device, the wearable device comprising a guide surface and one of a receptor and a latching mechanism, the latching mechanism comprising a release button, and a mounting apparatus, the mounting apparatus comprising an attachment mechanism and the other of the receptor and the latching mechanism, wherein the attachment mechanism is configured to operably engage the guide surface, wherein the latching mechanism is configured to operably engage the receptor, wherein the release button is configured to enable operable detachment of the wearable device from the mounting apparatus, wherein the wearable device is configured to be rotatable relative to the mounting apparatus in an instance in which the latching mechanism and the receptor are disengaged, wherein the wearable device and the mounting apparatus are configured to be attached to each other in an instance in which, on the one hand, the attachment mechanism and the guide surface are operably engaged and, on the other hand, the latching mechanism and the receptor are operably engaged, and wherein the attachment mechanism comprises a rail mechanism configured to guide the wearable device during attachment of the wearable device to the mounting apparatus, and wherein the rail mechanism is configured to disengage from the wearable device based on the attachment of the wearable device to the mounting apparatus.

5. The wearable device mounting system of claim 4, wherein the mounting apparatus comprises the latching mechanism and further comprises a shield plate, the shield plate being configured to cover at least a portion of the latching mechanism.

6. The wearable device mounting system of claim 4, wherein the guide surface and the receptor are disposed on a bottom surface of the wearable device.

7. The wearable device mounting system of claim 6, wherein the attachment mechanism and the latching mechanism are disposed on a top surface of the mounting apparatus.

8. The wearable device mounting system of claim 4, wherein the wearable device further comprises a groove, wherein the rail mechanism is configured to operably engage the groove.

9. The wearable device mounting system of claim 4, wherein a top surface of the mounting apparatus comprises a curved surface corresponding to a bottom surface of the wearable device, wherein the bottom surface of the wearable device defines at least a partially curved surface.

10. The wearable device mounting system of claim 4, wherein the mounting apparatus further comprises a plurality of fasteners configured to form a plurality of operable attachment points configured to engage a strap.

11. The wearable device mounting system of claim 4, wherein the wearable device further comprises a battery pack disposed at an opposite side of the guide surface from the receptor.

12. The wearable device mounting system of claim 4, wherein the wearable device is configured to be rotatable relative to the mounting apparatus immediately upon disengaging the latching mechanism and the receptor.

13. The wearable device mounting system of claim 4, wherein at least a portion of the attachment mechanism and at least a portion of the latching mechanism are configured to protrude out of a surrounding portion of a top surface of the mounting apparatus.

14. A method of operably attaching a wearable device to a mounting apparatus, the method comprising:

aligning the wearable device with the mounting apparatus, the wearable device comprising:

a guide surface and one of a receptor and a latching mechanism, wherein the wearable device is configured to be rotatable relative to the mounting apparatus in an instance in which the latching mechanism and the receptor are disengaged, and the mounting apparatus comprising:

an attachment mechanism and the other of the receptor and the latching mechanism, the latching mechanism comprising a release button, engaging the attachment mechanism and the guide surface;

engaging the latching mechanism and the receptor, wherein engaging the attachment mechanism and the guide surface occurs prior to engaging the latching mechanism and the receptor, wherein one of the wearable device or the mounting apparatus is rotated relative to the other of the wearable device or the mounting apparatus, the attachment mechanism comprises a rail mechanism, guiding, via the rail mechanism, the wearable device to attach the wearable device to the mounting apparatus; and disengaging the rail mechanism from the wearable device based on the attachment of the wearable device to the mounting apparatus.

15. The method of claim 14, wherein one of the wearable device or the mounting apparatus is rotated to engage the receptor and the latching mechanism of the other of the wearable device or the mounting apparatus after engagement of the attachment mechanism and the guide surface.

16. The wearable device mounting system of claim 4, wherein the wearable device comprises a groove, wherein the rail mechanism is configured to operably engage the groove, and wherein the rail mechanism comprises a pair of rails configured to pivot independent of the groove during the detachment of the wearable device from the mounting apparatus.

17. The mounting apparatus of claim 1, wherein the wearable device comprises a groove, wherein the rail mechanism is configured to operably engage the groove, and wherein the rail mechanism comprises a pair of rails configured to pivot independent of the groove during the detachment of the wearable device from the mounting apparatus.

* * * * *